US005228306A

United States Patent [19]

Shyu et al.

[11] Patent Number: 5,228,306

[45] Date of Patent: Jul. 20, 1993

[54] APPARATUS FOR CONTROLLING AIR-EXCHANGE AND PRESSURE AND DETECTING AIRTIGHT CONDITIONS IN AIR-CONDITIONED ROOM

[75] Inventors: Jia-Ming Shyu; Djang-Jer Lee, both of Hsinchu Hsien, Taiwan

[73] Assignee: Norm Pacific Automation Corp., Taiwan

[21] Appl. No.: 871,079

[22] Filed: Apr. 20, 1992

[51] Int. Cl.[5] ..... F25B 49/00; F25D 17/08

[52] U.S. Cl. ..... 62/176.6; 62/129; 62/262; 454/256; 236/49.3

[58] Field of Search ..... 62/176.6, 176.1, 262, 62/177, 178, 179, 180, 186, 325, 126, 127, 125, 129, 78; 236/44 R, 44 A, 44 C, 49.3, 91 R, 91 C; 454/238, 239, 234, 158, 256; 165/16

[56] References Cited

U.S. PATENT DOCUMENTS

| | | | |
|---|---|---|---|
| 2,161,312 | 6/1939 | Pritchard | 62/176.6 X |
| 3,402,654 | 9/1968 | Berst | 454/238 X |
| 4,257,319 | 3/1981 | Kucharczyk | 454/256 |
| 4,478,053 | 10/1984 | Yano et al. | 62/262 |
| 4,517,810 | 5/1985 | Foley et al. | 165/16 X |
| 4,702,753 | 10/1987 | Kowalczyk | 454/158 X |
| 5,024,263 | 6/1991 | Laine et al. | 165/1 |

FOREIGN PATENT DOCUMENTS

| | | | |
|---|---|---|---|
| 0142138 | 8/1983 | Japan | 62/176.6 |

*Primary Examiner*—Harry B. Tanner
*Attorney, Agent, or Firm*—Steven M. Rabin

[57] ABSTRACT

An apparatus for controlling air-exchange and pressure conditions in an air-conditioned room by opening and closing ducts and operating fans. The apparatus provides required indoor air pressure, such as a positive pressure for preventing dust from entering a room, or a cyclically modulated pressure in specific modes for achieving special atmospheric effects, such as to improve the spirits of occupants or to expel insects. The rate of change of the indoor pressure relative to the outdoor pressure can be measured in order to detect the degree of airtightness of the room. A warning signal is triggered when an abnormal condition of airtightness occurs, so that users may take steps to minimize unnecessary air-exchange, reduce energy consumption, and increase efficiency for air filtering and air conditioning.

22 Claims, 3 Drawing Sheets

APPARATUS FOR CONTROLLING AIR-EXCHANGE AND PRESSURE AND DETECTING AIRTIGHT CONDITIONS IN AIR-CONDITIONED ROOM

BACKGROUND OF THE INVENTION

This invention relates to an apparatus for controlling the air-exchange, and air pressure, and for detecting the airtightness, in air-conditioned space, which apparatus is able to be integrated with an air-conditioner and, through controlling the ON-OFF statuses of several ducts, vents and fans of the air-conditioner, to achieve good air-circulation within the interior, desired air-exchange, precise adjustment of pressure difference between the interior and the exterior, and control of some specific atmospheric modes. This apparatus comprises a microprocessor controller to control the operations of the above mentioned mechanisms so as to provide required in pressure condition to the interior. It also detects the airtightness of the interior by monitoring the rate of change of pressure difference between interior and exterior, and triggers a warning signal while detecting an abnormal airtightness (excessive leakage) in order to remind the user to take actions to avoid unnecessary energy waste.

Some annoying situations often exist in a conventional living space such as a dusty room, or a room filled with air that has infiltrated from fissures around doors or windows etc. and which is polluted or has excessive with improper humidity and temperature. These certainly damage the quality of living and are harmful to human health. Since airflow occurs travels from a space of higher pressure to a space of lower pressure, therefore providing a device that keeps the interior air pressure higher than that of the exterior will easily avoid these annoying situations and provide users a clean and healthy environment. Yet to some specific spaces such as a hospital, in order to prevent germs or virus dissipating from any fissure through airflow to an exterior space, a proper negative pressure at the interior (the interior air pressure is lower than that at the exterior) is required.

Furthermore, appropriate pressure variation inspires one's spirit and health. For example, a continuous air pressure modulation, in which repeatedly the air pressure increases quickly and is reduced slowly, provides an environment to raise one's spirity. A continuous air pressure modulation, that has frequent quick pressure reduction and slow pressure rise, makes insects in the interior feel uncomfortable and encourage them to escape from the interior. A conventional air conditioning system does not provide an indoor pressure control function, nor generate different atmospheric modes through the modulation of interior air pressure.

In an air-conditioned room, in which the polluted interior air (such as air having a high density of carbon dioxide etc.) shall be removed at proper time and fresh air is introduced from the exterior, this is called air-exchange. Though a conventional window type air-conditioner provides a manual air-exchange gateflap to provide air-convection between interior and exterior, the quantity and direction of convected air changes according to the pressure conditions of interior and exterior. Therefore, the quantity of air-exchange can not be modulated, nor can the direction of air lead-in or air exhaust be controlled. Thus, the conventional air-conditioner could exhaust a clean interior air and suck some unclean exterior air in. Therefore, in practice it can not achieve an effective air-exchange. And a separate type conventional air-conditioner provides no air vent; thus, no air-exchange is possible.

Airtightness of a general purpose building is limited due to the fissures around doors, windows, walls etc. and since sometimes even the doors or windows are left due to the neglect of users. In an air-conditioned environment with the above mentioned conditions, conditioned air will leak through the fissures or openings. A conventional air-conditioner is not equipped with any means to measure, and thereby ascertain, the airtightness, or a device to warn of leakage to someone so that proper actions may be taken to stop an abnormal loss.

The present invention accordingly, in order to improve the efficiency of air-conditioning and protect human health, provides an apparatus able to control air-exchange and air pressure of an conditioned space, also able to detect and warn of airtightness in that space. To a space having a proper airtightness, the present invention is able to provide required pressure modulation and air-exchange. While an air-conditioned space is without a proper airtightness, the present invention triggers a warning signal to remind users of the space to check the airtightness so as not to waste energy. That is, a main object of this invention is to provide an air-exchange and pressure controlling apparatus able to provide a comfortable and effective air-conditioned space.

The other objects and effects of the present invention will be apparent from the following description of an embodiment of the invention and the accompanying drawings.

SUMMARY OF THE INVENTION

The present invention, while integrated with an air-conditioner, basically comprises indoor sensors and outdoor sensors of temperature, humidity and pressure for sensing separately the temperature, humidity and pressure of interior and exterior. A microcomputer controller then calculates the humidity difference, temperature difference and pressure difference between the interior and the exterior. The air-conditioning power respective to those sensed values and user's requirements is then calculated. There are sensors for sensing the number the persons exists in the interior and sensing the quality of pollutants or poisons in the air of that space. With all these values the microprocessor calculates a required quantity of air-exchange and sends corresponding control signals to respective actuators (of, for example, vents, refrigerant compressor, fan motors etc.) that control the degree of air-conditioning, air-exchange (leading outdoor air indoors and exhausting indoor air outdoors) and air-mixing (operation that sucks in non-temperature adjusted, non-humidity adjusted interior air and mixes it with temperature adjusted, humidity adjusted interior return air and with exterior inlet air, so as to adjust the temperature and humidity of the air output from the apparatus). At each lead-in or exhaust operation, the microprocessor stores the speed of each fan and the pressure difference between interior and exterior and its variation rate (rate of change. Comparing the variation rate of the pressure difference with the stored maximum variation rate under the same pressure difference of interior and exterior, the current (present) airtightness of the interior is then derived. In case the current variation rate is below an allowance range of the maximum variation rate, a pressure loss is indicated. This invention will then provide a warning to remind users to check the airtightness in the space used to produce the order not to waste energy in conditioned air, that will dissipate to the exterior. Also, the present invention will update the detected value of airtightness when there's a new one in the event of a renewal installation or change of the space. These structures and effects will be described with reference to the following description and the drawings.

BRIEF DESCRIPTION OF THE DRAWINGS

FIG. 2 is of a mode having sudden pressure rises; FIG. 3 is of a mode having sudden pressure drops, and FIG. 4 is of a mode having large amplitude pressure change.

DESCRIPTION OF THE PREFERRED EMBODIMENTS

Figure 1:
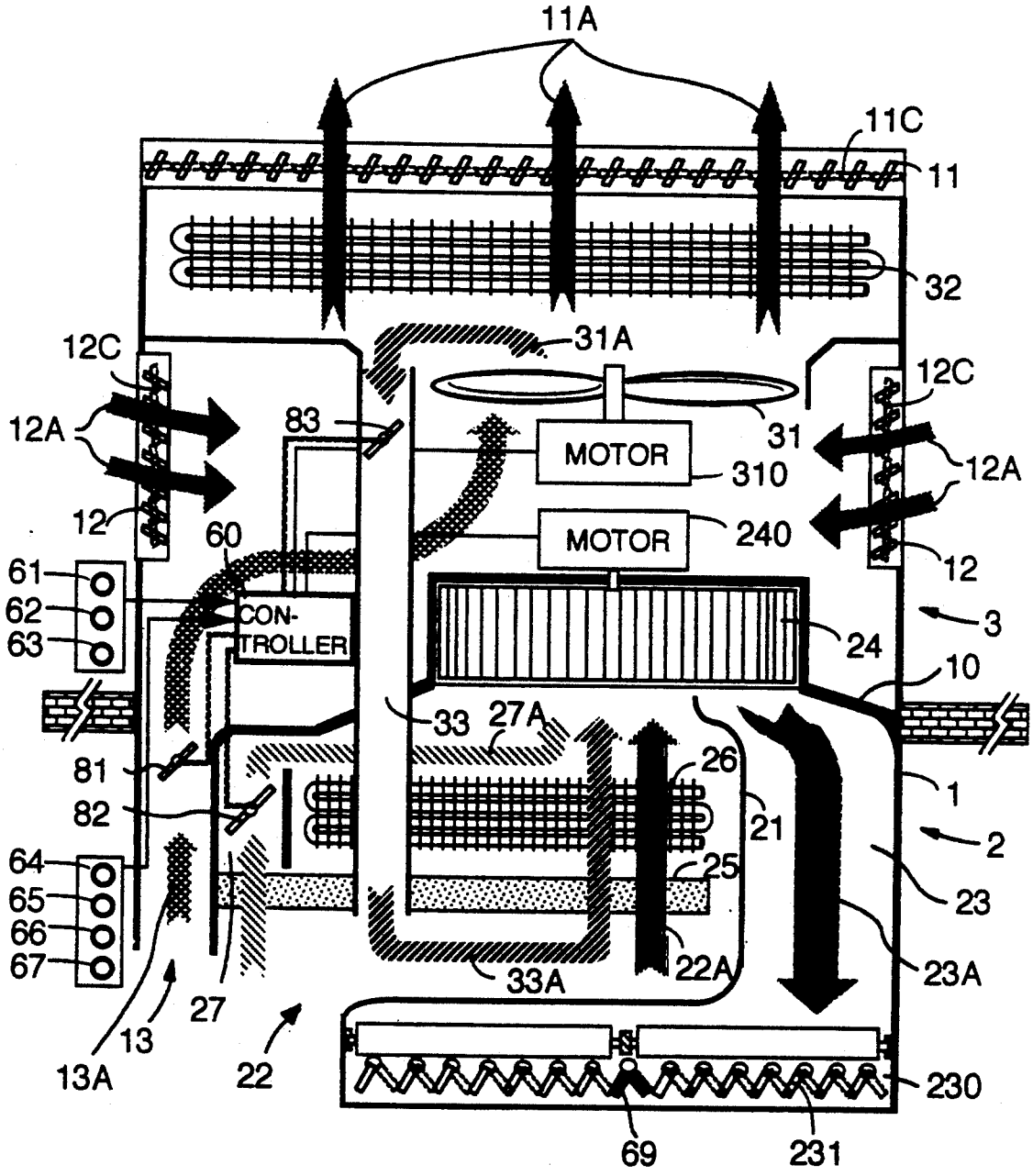
FIG. 1 is an illustration of the basic composition of an embodiment of the present invention.

FIG. 1 illustrates the basic structure of the present invention integrated with an air-conditioner. The air-conditioner has a housing 1, in which a septum 10 divides the interior portion of the air conditioner mainly into an interior compartment 2 and an exterior compartment 3. The interior compartment 2 is divided again by a septum 21 into an interior suction duct 22 and an interior discharge duct 23. An interior fan 24, installed between the interior suction duct 22 and interior discharge duct 23, is driven by a motor 240 to execute the interior air circulation. Within interior suction duct 22 there are filters 25 that include a mesh filter, an electrostatic filter, and an activated carbon filter etc., to filter dust particles, impurities and smell out of the air. An interior heat exchanger 26, or other unshown temperature, and humidity adjustment device, is provided to adjust the temperature, and humidity of the interior discharge air 23A. At the outer portion of the interior discharge duct 23 there is a flow direction adjustment device 230 used to control the direction of the interior discharge air 23A. On the housing 1 of the air conditioner along the exterior compartment 3, there are two inward vents 11 and an outward vent 12 which are composed of many blades and can be closed or opened by actuation of unshown actuating devices. An exterior fan 31 installed inside the exterior compartment 3 is driven by a motor 310. While vents 11 and 12 are opened, and fan 31 is activated to suck airflow 12A through vents 12 and impels airflow 11A through vent 11, an exterior heat exchanger 32 provided in the airflow 11A is affected. In fact, the interior heat-exchanger 26 and the exterior heat-exchanger 32 are linked with an unshown refrigerant compressor and form a refrigerating circuit in order to cool down or heat up the interior discharge air 23A. It is of prior air-conditioning arts and need not be described further.

The characteristics of the present invention are: each of the exterior vents 11, and 12 can be opened or closed independently; and there are several air ducts containing therein gateflaps which are activated independently to open or close, so that the air ducts can be controlled to achieve precise adjustment and control of interior air circulation, air-exhaust (causing pressure-drop), air lead-in (causing pressure-rise), and air-mixing (which are to be described below).

There is an air exhaust duct 13, arranged to connect the interior compartment 2 and the exterior compartment 3, in which there is an exhaust gateflap 81. While the gateflap 81 is open, interior air 13A is exhausted outdoors by suction created by the exterior fan 31 whereby any dirty air inside the room is removed and the interior air pressure is reduced. At a proper position around the interior suction duct 22 and away from the interior heat-exchanger 26, an air-mixing duct 27 is provided to bypass some interior air 27A around the heat exchanger 26 to directly enter the interior fan 24. An air-mixing gateflap 82 is installed in the duct 27 to control air-mixing (as will be described later). Also, an air lead-in duct 33 is located between the interior suction duct 22 and the discharge side of the exterior fan 31, and a lead-in gateflap 83 is installed in the duct 33. While the lead-in gateflap 83 is open, by suction and impelling of the interior fan 24 and the exterior fan 31, exterior air 31A is sucked into interior space to provide fresh air at the interior or to raise the interior air pressure. The operations of the exhaust gateflap 81, air-mixing gateflap 82, lead-in gateflap 83, interior fan 24, exterior fan 31, vents 11 and 12, etc., are driven and controlled by control currents or signals from a controller 60 which comprises a microprocessor. The output of the controller 60 is calculated from values sensed by several specific sensors installed around the exterior compartment 3 and the interior compartment 2, and processed with program stored in the controller 60 and from the user's requirements input through an unshown user interface. These sensors include pressure sensor 61, temperature sensor 62, and humidity sensor 63, located at the exterior compartment 3, that sense exterior pressure, temperature and humidity, respectively, and pressure sensor 64, temperature sensor 65, humidity sensor 66, air pollution sensor 67 and/or sensor 69 for detecting numbers of indoor persons, etc., positioned at interior compartment 2, that sense interior pressure, temperature and humidity, etc., respectively. The air-lead-in, air-exhaust and air-mixing functions will be described below.

First, the operation in lead-in modes causing air lead-in or pressure-rise is as follows: While the interior pressure sensor 64 senses that the interior pressure is lower than a required value, or when the controller 60 determines from sensor 69 the numbers of indoor persons, that there shall be air exchange, the controller 60 then controls and opens the lead-in gateglap 83 and adjusts the speed of the interior motor 240 and exterior motor 310 (when exterior fan 31 runs, the airflow 31A blocked by the heat exchange 32 causes pressure rise). At this time, the exhaust gateflap 81 is preferably closed (the vent 11 can also be actuated into a closed state 11C to speed up the air lead-in, if required) to achieve a proper air lead-in control. The exterior air 33A going through the lead-in duct 33 is guided to the front of filters 25 to make sure that any dust or smell is removed first. In this embodiment, the sensor 69 of numbers of indoor persons is an infrared ray sensor having a narrow detecting angle and is positioned at a horizontally swingable blade 231 of the flow direction adjustment device 230 and swings to sense the positions of human bodies and provides a signal to the controller 60 for counting the number of persons.

Secondly, the operation in exhaust modes causing air-exhaust or pressure-drop is as follows. While the sensor 67 of air pollution (such as a sensor of density of carbon dioxide) senses that the pollution of the interior air is beyond a preset value, or while the interior pressure sensor 64 senses that the interior pressure is higher than an expected value, the controller 60 modulates the speed of the exterior motor 31 and the time duration that the exhaust gateflap 81 is to be open (at this moment the lead-in gateflap 83 shall be in a closed state), so that the interior air 13A will, caused by suction of the exterior fan 31, be exhausted outdoors through the exhaust duct 13 and vent 11 as airflow 11A. To meet a specific requirement to exhaust the interior air speedily or drop the interior pressure quickly, the vents 12 can be actuated into a closed state 12C so as to exhaust at full-scale.

Furthermore, the operation causing air-mixing is to effectively provide interior discharge air 23A with required values of temperature and humidity, by sucking in a proper volume of non-temperature adjusted, non-humidity adjusted interior air 27A, and mixing it with proper volumes of interior returned air 22A, and possibly also with the exterior lead-in air 33A which have been temperature-adjusted by the interior heat-exchanger 26. Through mixing these airflows in different proportions, and having different temperatures and different humidities, specific requirements for the discharge air 23A can be flexibly and precisely obtained. That is, the controller 60 can, based on values sensed by sensors 61, 62 and 64, 65 of the temperatures and humidities of the interior and exterior air respectively, calculate an optimal proportion of interior air 27A, and exterior lead-in air 33A, relative to interior returned air 22A, for obtaining economically and effectively the interior discharge air 23A at the required temperature and humidity. The controller 60 can then calculate the power required to execute the temperature and humidity adjustment. All these determine the time durations of keeping the air-mixing gateflap 82 and the lead-in gateflap 83, open and also the speed of the interior and exterior motors 240, 310 and powers needed for the unshown compressor and temperature adjustment device (such as heat exchanger 26 etc.).

Briefly, the present invention, through the control of led-in and exhausted air, can modulate the interior air pressure, and through the air-mixing, can modulate the temperature and humidity of the interior air as required.

Furthermore, as the interior pressure can be precisely controlled by the present invention, therefore, the present invention may keep the interior pressure usually higher than that of the exterior in order to keep undersired or dusty outdoor air from in filtrating into the interior. It may further vary the interior pressure in some specific modes for different atmosphere conditions, such as the modes shown in the FIGS. 2, 3 and 4.

Figure 2:
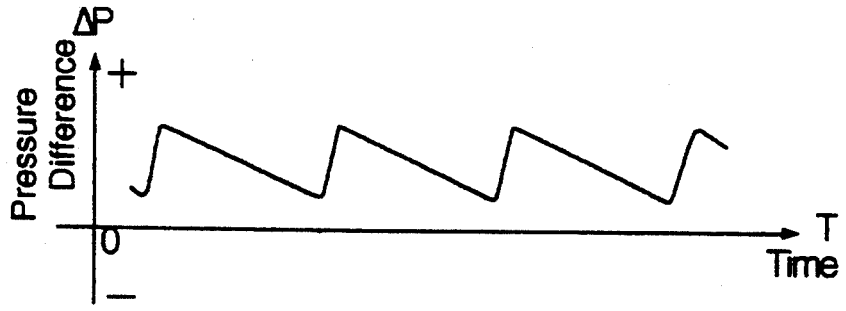
FIGS. 2, 3, and 4 are diagrams illustrating different cyclical modulation modes of difference in pressures between the interior and exterior, where

FIG. 2 is a diagram illustrating a pressure control mode that inspires one's spirits. The interior pressure is kept higher than that of exterior with the pressure difference $\Delta P$ in sudden-rise and slow-drop cycles with proper period and amplitude; at each sudden-rise, since the pressure is increased with in a short time, the weight and oxygen content of a unit volume of air increase too, so that the persons inside the room breath and get oxygen easily and comfortably. This inspires one's respiration physically and cheers one up mentally; while during the period of slow drop in pressure, the pressure is reduced at a rate that permits human beings to adjust. Thus, people will not observe the pressure reduction and the worsening air/supply.

Figure 3:
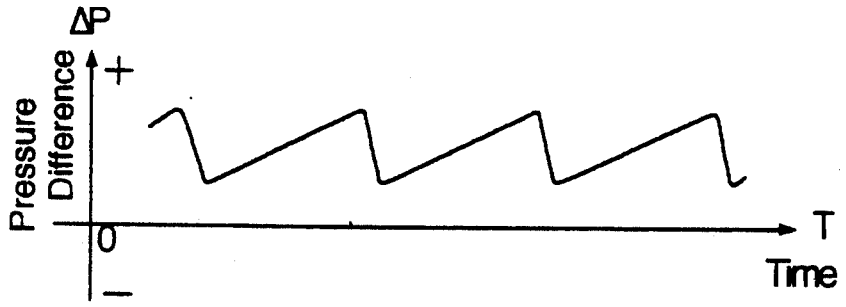

FIG. 3 is a diagram illustrating a pressure control mode that expels insects. Because insects are quite sensitive to any slight weather change, the present invention is able to periodically modulate interior pressure while no one is in the room in cycles of sudden drop and slow rise in pressure (These pressure changes may be accompanied by proper concurrent temperature and humidity modulation). The purpose is to provide an environment that is not suitable for insects to reside so that they will escape. Then a living space without insect damage is obtained.

Figure 4:
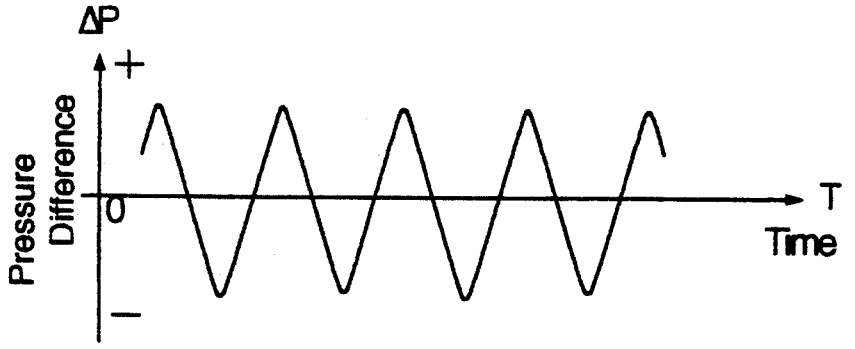

FIG. 4 illustrates a pressure control mode having speedy air-exchange cycles. In case there is a blaze or gas leakage in the interior space, the present invention, automatically from temperature or gas detection, or upon a user's request, runs a full-scale air exchange to have the pressure difference $\Delta P$ between interior space and exterior space change quickly with a large amplitude periodically. That is, at one moment it goes to a large positive pressure and at another moment it goes to a large negative pressure. The purpose of this modulation is to speed up the air-exchange between interior space and exterior space to reduce any possible damage to persons in the interior space.

Besides the above-mentioned pressure modulation modes, the present invention of course can provide other modes of pressure changes for specific atmosphere effects.

Figure 5:
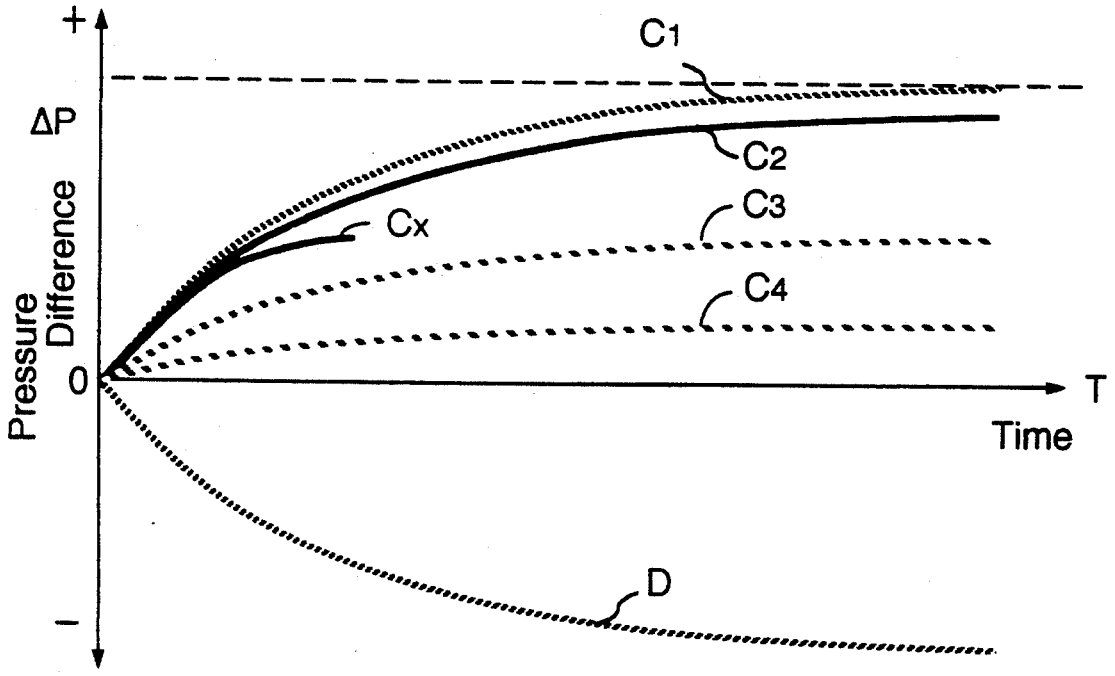
FIG. 5 is a diagram showing curves of variation of pressure difference under discharging or suction procedures for an interior under specific airtightness.

As the present invention effectively controls the renewal of interior air and interior pressure, an optimal airtightness can be applied to the airconditioned environment. FIG. 5 shows curves of pressure difference $\Delta P$ in relation to degrees of airtightness conditions. Due to the existence of fissures around a building, the degree of airtightness condition is limited, so that while the present invention goes on to increase the interior air pressure, some interior air will flow out through these fissures. If the total cross-area of these fissures is a fixed value (so that any fissure is original and no other opening occurs), then with the increase of interior pressure, the airflow that leaks through these fissures increases gradually in relation to the pressure difference $\Delta P$ between interior and exterior. However, at last the pressure difference $\Delta P$ will become a fixed value because of the equivalence of volume of air led in and the volume of air leaked out, as shown in FIG. 5. That is, while the present invention does not increase the pressure to the interior space, the pressure difference $\Delta P$ is zero; if in an ideal closed environment (yet still with the lead-in duct of the present invention), increasing the pressure in full-scale by air led in by the present invention, a pressure curve C1 having a maximum efficiency will be obtained. However, in a practical environment, if leakage occurs from some other fissures, pressure curves that are lower than the ideal pressure curve C1, like curves C2, C3, and C4, will be obtained, and these curves are indicators of the airtightness in each respective environment. That is, at each pressure difference $\Delta P$ between the interior and exterior of a room, there is a maximum rate of pressure increase (the maximum rate of change of pressure difference between the interior and the exterior in a unit time interval). In environments with the same airtight conditions, the pressure-increasing curve will be extended or shortened respectively along time axis T relative to the speed of air led in (which speed can be changed by changing the speed of the motors 240 and 310 of FIG. 1), yet the maximum pressure difference ΔP remains the same. But if the leakage increases in that environment, then the maximum pressure difference ΔP will be reduced accordingly and will even reach zero with large enough leakage. Therefore, after a certain period of operation, the apparatus of the present invention will cause the maximum pressure difference ΔP that is achievable for that environment. And during a pressure-raising operation, this apparatus calculates and records the pressure difference ΔP and the average rate of pressure-rise relative to that pressure difference ΔP at that moment. The current rate is compared to a maximum rate previously recorded (if any) under in the same situation. If any abnormal change occurs such as would be caused by a sudden leak, then from comparing the current (present) rate a with that maximum rate, pressure abnormality will be detected. If the rate of the pressure rise is lower than an expected normal value such as the curve Cx shown on the figure, the controller 60 will trigger a signal to actuate a warning device which uses sound, light, a diagram or other method to reminding users to check and adjust the conditions of airtightness conditions (such as to close the windows, or door, etc.) to avoid energy waste in air that leaks out to the exterior nonpurposely.

The above-mentioned method and operation is also apt for detecting a pressure-drop condition. During control of pressure-drop, it can detect and warn of any abnormal situation according to a normal pressure-drop curve D as shown in FIG. 5.

Since the present invention is to detect and compare continuously the rate of pressure-rise and pressure-drop at each time interval under each respective pressure condition, therefore the stored data is updated upon any change too. Therefore, even if the condition of the environment or the location of the air-conditioner changes, the condition of respective airtightness is soon detected.

As described, the present invention effectively controls and detects conditions of air-exchange, pressure and airtightness, and performs a warning function when necessary, so that the present invention can achieve the purposes of energy saving and improvement of the efficiency of air-conditioning.

The above embodiments and drawings are described to better explain the characteristics and structure of the present invention. As many modifications, such as to extend the air exhaust duct 13 and the lead-in duct 33 (please refer to FIG. 1) so as to construct a separate type air-conditioner, or change to a ventilation device that does not adjust the temperature or humidity, etc., will be apparent to those skilled in the art, it is to be understood that the invention is limited only the following claims.

What is claimed is:

1. An apparatus for controlling air pressure in an interior space, controlling air exhausted from the interior space to an exterior space outside the interior space, and controlling air led in from the exterior space to the interior space, comprising:

an interior compartment;

a first fan in said interior compartment, said first fan having a suction side and a discharge side;

an exterior compartment;

a second fan in said exterior compartment, said second fan having a suction side and a discharge side;

a lead-in duct, connecting said suction side of said first fan and said exhaust side of said second fan;

a lead-in gateflap for selectively opening and closing said lead-in duct;

a series of filters arranged to remove dust, impurity and smell from air led by said lead-in duct to said suction side of said first fan, before being discharged by said first fan;

an exhaust duct, connecting said interior compartment and said suction side of said second fan;

an exhaust gateflap for selectively opening and closing said exhaust duct; and means for controlling operations of said first fan, said second fan, said lead-in gateflap and said exhaust gateflap in a plurality of modes, including a first mode in which exterior air is led into the interior space through said lead-in duct, while at least one of said first and second fans operates, so as to increase the interior air pressure, and a second mode in which while said second fan operates interior air is exhausted through said exhaust duct so as to reduce the interior air pressure.

2. An apparatus according to claim 1, wherein said controlling means is responsive to detected values of the interior air pressure and exterior air pressure and values input form a user interface to control said operations so as to increase and decrease the interior air pressure cyclically.

3. An apparatus according to claim 2, wherein said controlling means further controls the operations of the first and second fans and the lead-in and exhaust gateflaps in response to sensed values selectively provided from a sensor of the number of persons in the interior space, from a sensor of interior air pollution, and from data input through said user interface.

4. An apparatus according to claim 1, wherein said first fan further circulates interior air; said interior compartment further includes means for sensing temperature, means for sensing humidity and means for adjusting temperature and humidity so as to monitor and adjust temperature and humidity of the circulated interior air.

5. An apparatus according to claim 4, wherein said exterior compartment further includes means for sensing temperature and means for sensing humidity, to provide signals indicating respectively the temperature and humidity of said exterior air, for use by said controlling means.

6. An apparatus according to claim 5, wherein said interior compartment further includes an air-mixing duct with a gateflap controlled by said controlling means for leading a part of said circulated interior air, which has not been temperature and humidity-adjusted, to be mixed with temperature-adjusted interior air so as to adjust temperature and humidity of said interior air.

7. An apparatus according to claim 1, wherein said interior compartment includes means guiding interior air to said suction side of said first fan to be circulated by said first fan, said filters being disposed in a position between said lead-in duct and said suction side of said first fan so as to filter both the air led by said lead-in duct and the circulating interior air before such air is discharged by said first fan.

8. An apparatus according to claim 1, further comprising means for guiding the interior air from the interior space into said interior compartment and to said suction side of said first fan, means for guiding air from the exhaust side of said first fan to the interior space, means, including first closable vents in a wall of said exterior compartment, for guiding exterior air from the exterior space into said exterior compartment and to the suction side of said second fan, and means, including second closable vents in said wall of said exterior compartment, for guiding air from the exhaust side of said second fan to the exterior space.

9. An apparatus according to claim 8, wherein said operations controlling means controls opening and closing of said vents in said plurality of modes.

10. An environmental control apparatus for an enclosed space, the apparatus comprising:

means defining an interior compartment having a first inlet for receiving interior air from the enclosed space and a first outlet for delivering air to the enclosed space;

a first fan in said interior compartment, said first fan having a suction side in fluid communication with said first inlet and an exhaust side in fluid communication with said first outlet;

means defining an exterior compartment having a second inlet for receiving air from an exterior space and a second outlet for exhausting air to the exterior space;

a second fan in said exterior compartment, said second fan having a suction side in fluid communication with said second inlet and an exhaust side in fluid communication with said second outlet;

a lead-in duct connecting said suction side of said first fan and said exhaust side of said second fan;

a lead-in gateflap for selectively opening and closing said lead-in duct;

an exhaust duct connecting said suction side of said second fan to said interior compartment so that said suction side of said second fan is in fluid communication with said first inlet;

an exhaust gateflap for selectively opening and closing said exhaust duct; and means for controlling operations of said first and second fans and said lead-in and exhaust gateflaps in a plurality of modes so as to control air inflow, outflow and pressure in the enclosed space, said plurality of modes including lead-in modes in which the first and second fans are in operation, said lead-in gateflap is open, and air from the exterior space flows into the enclosed space through said lead-in duct so as to increase the air pressure in the enclosed space, and exhaust modes in which the second fan is in operation, the exhaust gateflap is open, and air from the enclosed space is exhausted to the exterior space through said exhaust duct so as to reduce the air pressure in the enclosed space.

11. An apparatus according to claim 10, wherein said second outlet is a first closable vent and said second inlet is a second closable vent, and said operations controlling means controls opening and closing of said vents such that in said lead-in modes, said first vent is closed and said second vent is open, and in said exhaust modes, said first vent is open and said second vent is closed.

12. An apparatus according to claim 10, wherein said plurality of modes includes a first mode in which the first and second fans are in operation, said lead-in gateflap is open, said exhaust gateflap is closed, and air from the exterior space flows into the enclosed space through said lead-in duct so as to increase the air pressure in the enclosed space, and a second mode in which the second fan is in operation, the lead-in gateflap is closed, the exhaust gateflap is open, and air from the enclosed space is exhausted to the exterior space through said exhaust duct so as to reduce the air pressure in the enclosed space.

13. An apparatus according to claim 12, wherein said second outlet is a first closable vent and said second inlet is a second closable vent, and said operations controlling means controls opening and closing of said vents such that in said first mode, said first vent is closed and said second vent is open, and in said second mode, said first vent is open and said second vent is closed.

14. An apparatus according to claim 10, wherein the means defining the interior and exterior compartments comprise a rectangular housing, and a septum separating a space within said housing into the interior and exterior compartments, the lead-in and exhaust ducts within said housing, the housing adapted for placement in an opening in a wall of a building with the first inlet and first outlet provided in said housing to be exposed the indoor environment of the building and with the second inlet and second outlet provided in said housing to be exposed to an outdoor environment.

15. An environmental control apparatus according to claim 10, further comprising a first sensing means for sensing the air pressure in the enclosed space, a second sensing means for sensing the air pressure in the exterior space and a third sensing means for sensing the number of persons occupying the enclosed space, and wherein said operations controlling means means further controls the operations of the first and second fans and the lead-in and exhaust gateflaps in response to values input through a user interface and values sensed by said first, second and third sensing means.

16. An environmental control apparatus according to claim 15, wherein said controlling means further controls the operations of the first and second fans and the lead-in and exhaust gateflaps in response to values sensed by a sensor of air pollution in the enclosed space.

17. An environmental control apparatus according to claim 10, further comprising a first sensing means for sensing the air pressure in the enclosed space, a second sensing means for sensing the air pressure in the exterior space and a third sensing means for sensing air pollution in the enclosed space, and wherein said operations controlling means means further controls the operations of the first and second fans and the lead-in and exhaust gateflaps in response to values input through a user interface and values sensed by said first, second and third sensing means.

18. An environmental control apparatus according to claim 10, further comprising means for measuring a difference between the air pressure in said enclosed space an the air pressure in said exterior space, said operations controlling means controlling said exhaust gateflap in response to air pressure differences measured by said measuring means during operations in said exhaust modes.

19. An environmental control apparatus for an enclosed space, the apparatus comprising:

means defining an interior compartment having a first inlet for receiving interior air from the enclosed space and a first outlet for delivering air to the enclosed space;

a first fan in said interior compartment, said first fan having a suction side in fluid communication with said first inlet and an exhaust side in fluid communication with said first outlet;

means defining an exterior compartment having a second inlet for receiving air from an exterior space and a second outlet for exhausting air to the exterior space;

a second fan in said exterior compartment, said second fan having a suction side in fluid communication with said second inlet and an exhaust side in fluid communication with said second outlet;

a lead-in duct connecting said suction side of said first fan and said exhaust side of said second fan;

a lead-in gateflap for opening and closing said lead-in duct;

an exhaust duct connecting said suction side of said second fan to said interior compartment so that said suction side of said second fan is in fluid communication with said first inlet;

an exhaust gateflap for opening and closing said exhaust duct; and means, responsive to values input through a user interface and measured values of the air pressure in the enclosed space and the air pressure in the exterior space, for controlling operations of said first and second fans and said lead-in and exhaust gateflaps in a plurality of modes so as to control air inflow, outflow and pressure in the enclosed space, said plurality of modes including one mode in which the air pressure in the enclosed space is increased and decreased cyclically, and wherein with the air pressure in the enclosed space being increased during said one mode at least one of the first and second fans is in operation, said lead-in gateflap is open, said exhaust gateflap is closed, and air from the exterior space flows into the enclosed space through said lead-in duct, and with the air pressure in the enclosed space being decreased during said one mode the second fan is in operation, the lead-in gateflap is closed, the exhaust gateflap is open and air from the enclosed space is exhausted to the exterior space through said exhaust duct.

20. An environmental control apparatus according to claim 19, wherein said controlling means further controls the operations of the first and second fans and the lead-in and exhaust gateflaps in response to values sensed by a sensor of the number of persons in the enclosed space.

21. An environmental control apparatus according to claim 20, wherein said controlling means further controls the operations of the first and second fans and the lead-in and exhaust gateflaps in response to values sensed by a sensor of air pollution in the enclosed space.

22. An environmental control apparatus for an enclosed space, the apparatus comprising:

means defining an interior compartment having a first inlet for receiving interior air from the enclosed space and a first outlet for delivering air to the enclosed space;

a first fan in said interior compartment, said first fan having a suction side in fluid communication with said first inlet and an exhaust side in fluid communication with said first outlet;

means defining an exterior compartment having a second inlet for receiving air from an exterior space and a second outlet for exhausting air to the exterior space;

a second fan in said exterior compartment, said second fan having a suction side in fluid communication with said second inlet and an exhaust side in fluid communication with said second outlet;

a lead-in duct connecting said suction side of said first fan and said exhaust side of said second fan;

a lead-in gateflap for opening and closing said lead-in duct;

an exhaust duct connecting said suction side of said second fan to said interior compartment so that said suction side of said second fan is in fluid communication with said first inlet;

an exhaust gateflap for opening and closing said exhaust duct; and means for controlling operations of said first and second fans and said lead-in and exhaust gateflaps in a plurality of modes so as to control air inflow, outflow and pressure in the enclosed space, said plurality of modes including a first mode in which at least one of the first and second fans are in operation, said lead-in gateflap is open, and air from the exterior space flows into the enclosed space through said lead-in duct so as to increase the air pressure in the enclosed space, and a second mode in which the second fan is in operation, the exhaust gateflap is open, and air from the enclosed space is exhausted to the exterior space through said exhaust duct so as to reduce the air pressure in the enclosed space;

said operations controlling means storing a software program according to which said operations controlling means, while controlling said operations in at least one of said first and second modes, executes the following steps in response to repeatedly sensed values of the air pressure in the enclosed space and the air pressure in the exterior space:

calculating for predetermined time intervals, present differences between the sensed values of the air pressure in the enclosed space and the air pressure in the exterior space and present average rates of change of said present differences, comparing each present average rate with a largest average rate previously stored in association with a previously stored difference equal to the present difference, activating a warning device if the present average rate is smaller than the previously stored rate with which it is compared by an amount greater than a preset amount, and if the present average rate of change is larger than the previously stored largest average rate, substituting in storage the present average rate for the previously stored rate.

* * * * *